US010765268B2

(12) United States Patent
Hackett et al.

(10) Patent No.: US 10,765,268 B2
(45) Date of Patent: Sep. 8, 2020

(54) ANTI-SLIP SURFACES

(71) Applicant: Classic Marble (Showers) Limited, Ballygawley, Tyrone (GB)

(72) Inventors: Donald Hackett, Tyrone (GB); Christopher Hackett, Tyrone (GB)

(73) Assignee: Classic Marble (Showers) Limited, Ballygawley, Tyrone (GB)

( * ) Notice: Subject to any disclaimer, the term of this patent is extended or adjusted under 35 U.S.C. 154(b) by 18 days.

(21) Appl. No.: 16/307,826

(22) PCT Filed: Jun. 5, 2017

(86) PCT No.: PCT/EP2017/063622
§ 371 (c)(1),
(2) Date: Dec. 6, 2018

(87) PCT Pub. No.: WO2017/211769
PCT Pub. Date: Dec. 14, 2017

(65) Prior Publication Data

US 2019/0307296 A1 Oct. 10, 2019

(30) Foreign Application Priority Data

Jun. 6, 2016 (GB) ..... 1609864.2

(51) Int. Cl.
*A47K 3/40* (2006.01)
*A47K 3/00* (2006.01)

(52) U.S. Cl.
CPC ..... *A47K 3/40* (2013.01); *A47K 3/002* (2013.01)

(58) Field of Classification Search
CPC ..... A47K 3/40
USPC ..... 4/613
See application file for complete search history.

(56) References Cited

U.S. PATENT DOCUMENTS

| | | | |
|---|---|---|---|
| 2,809,380 | A | 10/1957 | Gruen |
| 3,942,199 | A | 3/1976 | Kollsman |
| 3,999,224 | A | 12/1976 | Kollsman |

FOREIGN PATENT DOCUMENTS

| | | | |
|---|---|---|---|
| CN | 202466350 | U | 10/2012 |
| EP | 1525948 | A1 | 4/2005 |
| JP | H10183962 | A | 7/1998 |
| JP | 2008161363 | A | 7/2008 |

*Primary Examiner* — Christine J Skubinna
(74) *Attorney, Agent, or Firm* — Volpe and Koenig

(57) ABSTRACT

A shower tray or other article having a face with an anti-slip surface comprising an array of spaced apart raised projections. Each projection has a height of between 0.5 mm and 1 mm and a top surface with an area of between 3.14 mm2 and 50.27 mm2, adjacent projections being spaced apart by between 10 mm and 16 mm. Each projection is shaped to have a right angled edge between its top and side. The projections are flared at the bottom. The anti-slip surface exhibits high anti-slip properties while being comfortable and easy to clean.

24 Claims, 4 Drawing Sheets

ANTI-SLIP SURFACES

FIELD OF THE INVENTION

The present invention relates to anti-slip surfaces and articles having anti-slip surfaces. The invention relates particularly but not exclusively to articles of sanitary ware, such as shower trays, bath tubs, tiles and wet room flooring, with anti-slip surfaces.

BACKGROUND TO THE INVENTION

It is known to provide articles of sanitary ware, such as shower trays, with an anti-slip surface in the form a coating that gives a rough surface finish. However, such coatings tend to have a lifetime that is shorter than the lifetime of the article to which it is applied. Also, applying and re-applying the coating can be difficult and inconvenient.

It is also known to provide anti-slip surfaces in the form of spaced apart raised formations on the shower tray. In order to facilitate comfort, cleaning and manufacture, the formations are relatively large, rounded and widely spaced, which limits their anti-slip performance. In particular, known anti-slip surfaces of this type tend to fail to meet modern anti-slip standards, such as the pendulum coefficient of friction test defined by British Standard BS 7976: Parts 1-3, 2002 and A1, 2003.

It would be desirable to provide an anti-slip surface that is durable, exhibits high anti-slip properties and is relatively easy to clean.

SUMMARY OF THE INVENTION

A first aspect of the invention provides an article comprising at least one face having an anti-slip surface, the anti-slip surface comprising a plurality of spaced apart projections raised with respect to the respective face, said projections having a top surface and a side extending between said top surface and said respective face, and wherein each projection is shaped to have an angular edge between said top surface and said side, and wherein each projection has a height of between 0.5 mm and 1.5 mm and a top surface with an area of between 3 $mm^2$ and 64 $mm^2$, adjacent projections being spaced apart by between 10 mm and 16 mm.

From a second aspect, the invention provides an article comprising at least one face having an anti-slip surface, the anti-slip surface comprising a plurality of spaced apart projections raised with respect to the respective face, said projections having a top surface and a side extending between said top surface and said respective face, and wherein each projection is shaped to have an angular edge between said top surface and said side, the side being shaped to flare outwardly at the base of the projection. Preferably, each projection has a height of between 0.5 mm and 1.5 mm and a top surface with an area of between 3 $mm^2$ and 64 $mm^2$, adjacent projections being spaced apart by between 10 mm and 16 mm.

Preferably, said angular edge is right angled.

Preferably, said angular edge is annular, extending around the periphery of said top surface.

In preferred embodiments, at least a peripheral portion of, and preferably the whole of, said top surface is flat.

Typically, the side is shaped such that it is substantially perpendicular to the top surface at said edge.

Preferably said top surface is circular.

Advantageously the projections are rigid (non-deformable). The preferred projections do not deform in response to the weight of a user standing or stepping on the anti-slip surface.

In preferred embodiments the side is shaped to flare outwardly at the base of the projection. Typically at least a lower part of the side is curved in transverse cross-section flaring outwardly at the base of the projection. Optionally the side is curved from said the edge to the respective face. Advantageously, the transverse cross-sectional curvature of the side is such that the side is tangential to the top surface at the edge. The side may have a transverse cross-sectional curvature with a constant radius. The size of the constant radius may be the same as the height of the projection. In preferred embodiments, said radius is between 0.5 mm and 1 mm, more preferably between 0.6 mm and 0.9 mm, and is most preferably 0.75 mm.

In some embodiments, said side comprises an upper portion, which forms the edge and extends from the edge part way to the respective face, and a flared lower portion extending from said upper portion to said respective face, wherein said upper portion is substantially perpendicular with said top surface. Preferably said lower portion of the side has a transverse cross-sectional curvature with a constant radius. Preferably the size of the constant radius is the same as the height of the lower portion. In preferred embodiments said radius is between 0.15 mm and 0.35 mm, more preferably between 0.2 mm and 0.3 mm, and is most preferably 0.25 mm.

In preferred embodiments the overall height of each projection is between 0.6 mm and 0.9 mm, and is most preferably 0.75 mm.

In embodiments having said upper portion, the height of the upper portion is preferably between 0.3 mm and 0.7 mm, preferably between 0.4 mm and 0.6 mm, most preferably 0.5 mm.

In embodiments having said lower portion, the height of the lower portion is between 0.1 mm and 0.5 mm, more preferably between 0.15 mm and 0.35 mm, most preferably 0.25 mm.

Typically the area of the top surface is between 9 $mm^2$ and 36 $mm^2$, most preferably being 20.25 $mm^2$. In preferred embodiments said top surface is circular and has an area of between 3.14 $mm^2$ and 50.27 $mm^2$, more preferably between 7.07 $mm^2$ and 28.27 $mm^2$, the most preferred value being 15.90 $mm^2$.

Preferably the projections are arranged in an array comprising rows and columns of said projections. It is preferred that said array is a regular array, preferably a regular rectangular array.

In preferred embodiments the spacing between adjacent projections, in particular the respective centre of adjacent projections, e.g. a centre point on the top surface, in any row or column is between 10 mm and 16 mm, more preferably between 11 mm and 13 mm, most preferably being 12 mm.

It is preferred that all of the projections in the array are of substantially uniform shape.

Preferably all of the projections in the array are of substantially uniform height.

Preferably all of the projections in the array are of substantially uniform size.

In preferred embodiments said projections are non-deformable.

It is preferred that said projections are integrally formed with said respective face.

In a preferred application said article is a tray for a shower or wet room. The tray has a face on which a user stands during use, the face being provided with said anti-slip surface.

Advantageously, said article is a moulded article, said projections being integrally formed, by moulding, with said at least one face.

From another aspect, the invention provides an anti-slip surface comprising a plurality of spaced apart projections raised with respect to the respective face, said projections having a top surface and a side extending between said top surface and said respective face, and wherein each projection is shaped to have an angular edge between said top surface and said side, and wherein, preferably, each projection has a height of between 0.5 mm and 1.5 mm and a top surface with an area of between 3 $mm^2$ and 64 $mm^2$, adjacent projections being spaced apart by between 10 mm and 16 mm.

From a further aspect, the invention provides a tray for a shower or wet room, said tray comprising at least one face having an anti-slip surface, the anti-slip surface comprising a plurality of spaced apart projections raised with respect to the respective face, said projections having a top surface and a side extending between said top surface and said respective face, wherein each projection has a height of between 0.5 mm and 1.5 mm and a top surface with an area of between 3 $mm^2$ and 64 $mm^2$, adjacent projections being spaced apart by between 10 mm and 16 mm, and wherein each projection is shaped to have an angular edge between said top surface and said side.

Advantageously, the anti-slip surface exhibits high anti-slip properties while being comfortable and easy to clean.

Further advantageous aspects of the invention will be apparent to those ordinarily skilled in the art upon review of the following description of specific embodiments and with reference to the accompanying drawings.

BRIEF DESCRIPTION OF THE DRAWINGS

Embodiments of the invention are now described by way of example and with reference to the accompanying drawings in which.

DETAILED DESCRIPTION OF THE DRAWINGS

Figure 1:
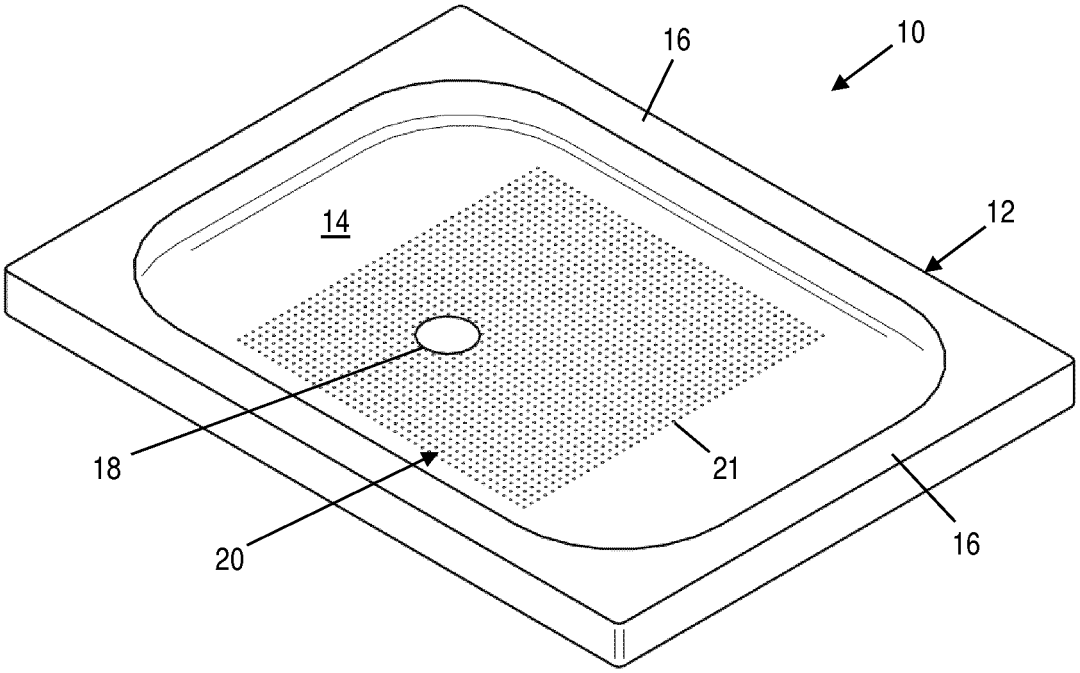
FIG. 1 is a perspective view of a first embodiment of a shower tray having an anti-slip surface embodying one aspect of the invention.

Referring now to FIGS. 1 to 5 of the drawings there is shown, generally indicated as 10, an article with an anti-slip surface embodying one aspect of the invention. In the illustrated embodiment, the article 10 is a shower tray although it will be understood that the invention is not limited to shower trays. The shower tray 10 comprises a base 12 having an upper face 14 on which a user (not shown) stands when showering. The illustrated shower tray 10 comprises a lip 16 surrounding the upper face 14 although in other embodiments the lip may be omitted. Usually a drainage aperture 18 is provided in the base 12, opening onto the upper face 14.

Figure 2:
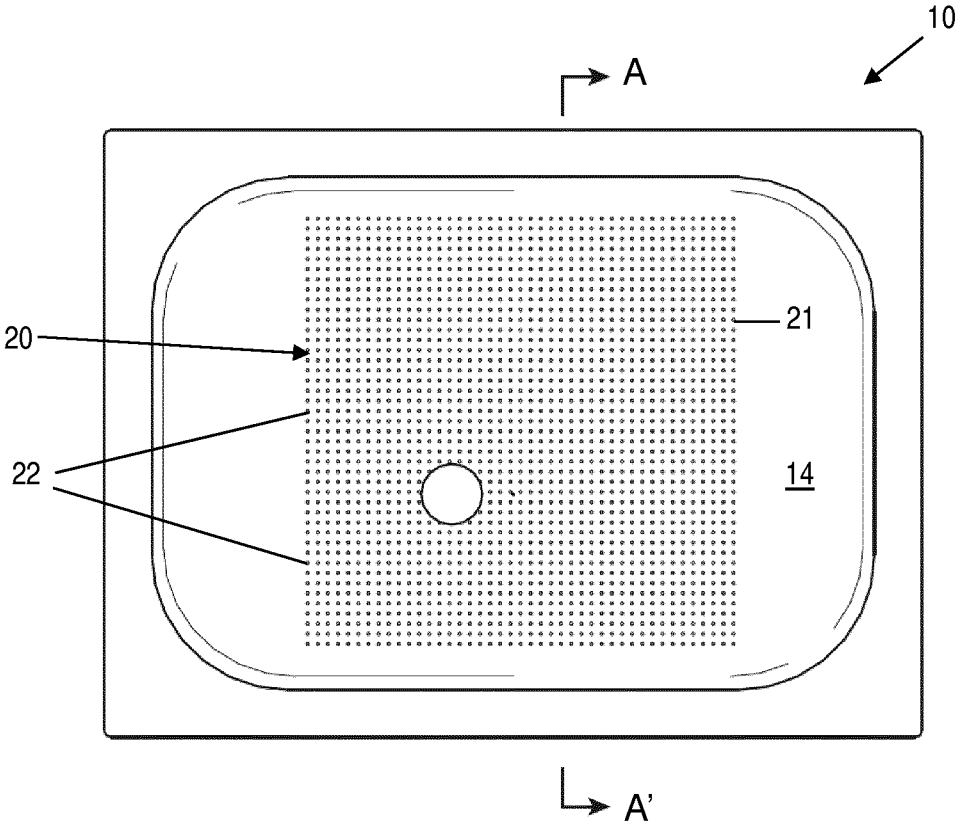
FIG. 2 is plan view of the shower tray of FIG. 1.
Figure 3:
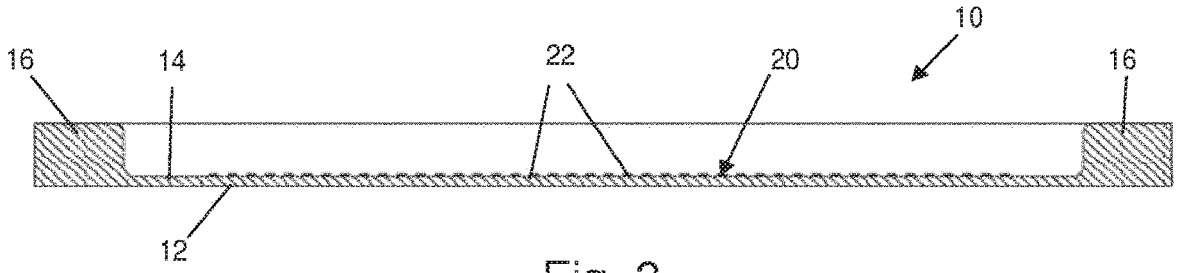
FIG. 3 is a sectional view of the shower tray of FIG. 1.

The upper face 14 is provided with an anti-slip surface 20 comprising a plurality of spaced apart projections 22 that are raised with respect to the upper face 14, typically such that they project substantially perpendicularly to the face 14. The anti-slip surface 20 may cover all or part of the upper face 14, as desired. Typically the anti-slip surface 20 is provided on substantially all of the area(s) that comes into contact with a user's feet during use. The projections 22 are preferably arranged in an array 21 comprising rows and columns of the projections 22. The spacing between adjacent projections 22 in a respective row is preferably constant, i.e. the projections in any given row are evenly spaced. It is also preferred that the inter-projection spacing of each row is the same as for the other rows. The spacing between adjacent projections 22 in a respective column is preferably constant, i.e. the projections in any given column row are evenly spaced. It is also preferred that the inter-projection spacing of each column is the same as for the other columns. In preferred embodiments the inter-projection spacing is the same in the rows and the columns. The rows and columns preferably run perpendicularly to each other. Therefore, the preferred array 21 of projections comprises a regular array 21, preferably a regular rectangular array 21. It will be understood that while the projections 22 of the anti-slip surface may be arranged to form a rectangular array 21, the overall shape of the anti-slip surface 20, or more particularly the peripheral shape of the array 21, need not be rectangular (as illustrated in FIGS. 1 and 2). In alternative embodiments, the overall shape of the array 21 and/or of the surface 20 may take any other desired shape, e.g. rounded, circular, polygonal or irregular. In alternative embodiments, the rows and columns need not be perpendicular to each other; they may be offset to run obliquely with respect to each other. While a regular array 21 of projections 22 is preferred, in alternative embodiments the projections may be arranged irregularly, i.e. be irregularly spaced apart.

In preferred embodiments, the spacing between adjacent projections 22 is between 10 mm and 23 mm, more preferably between 11 mm and 19 mm. More particularly, it is preferred that the spacing between adjacent projections 22 in any row or column is between 10 mm and 16 mm, more preferably between 11 mm and 13 mm. The most preferred spacing between adjacent projections 22 in any row or column is 12 mm. Accordingly, the most preferred embodiments comprise an anti-slip surface 20 comprising a regular rectangular array 21 of projections 22, each projection 22 being spaced apart from the, or each, adjacent projection in its respective row and column by 12 mm. While it is preferred that the projections 22 in the array 21 are regularly spaced apart, some embodiments may have irregular inter-projection spacing, the spacing preferably being within the ranges stipulated above. Optionally, the projections in part(s) of the array 21 may be regularly spaced apart while the projections in other part(s) of the array 21 may be irregularly spaced apart. The preferred spacing values provided above are intended to relate to the spacing of the respective centres of adjacent projections 22, e.g. the spacing between respective projection centre points when viewed in plan. This is illustrated as spacing S in FIG. 4. The preferred spacing range values and preferred values are inclusive and are given to the nearest millimetre. In other embodiments, the inter-projections may be outside of the ranges given above.

Figure 4:
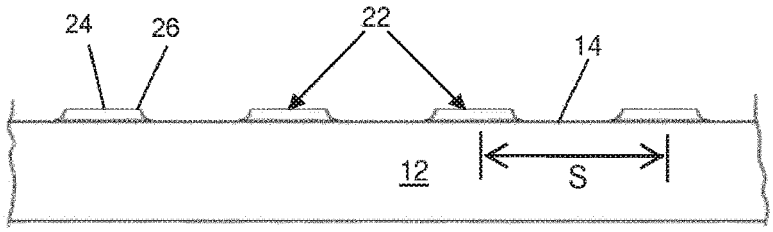
FIG. 4 is an enlarged side view of part of the anti-slip surface of the shower tray of FIG. 1.
Figure 5:
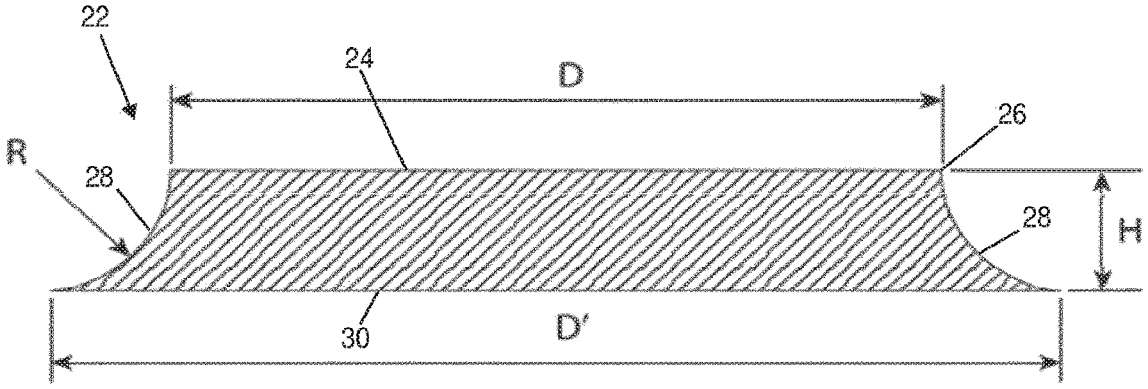
FIG. 5 is an enlarged side view of a projection that is part of the anti-slip surface of the shower tray of FIG. 1.
Figure 6:
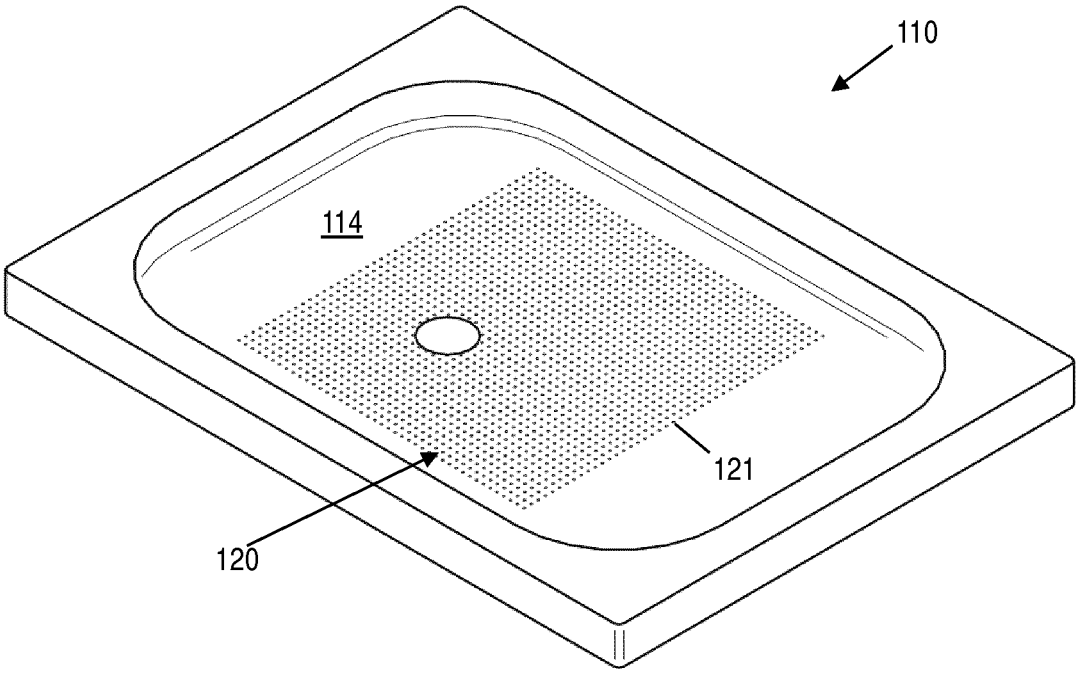
FIG. 6 is a perspective view of a second embodiment of a shower tray having an anti-slip surface embodying one aspect of the invention.
Figure 7:
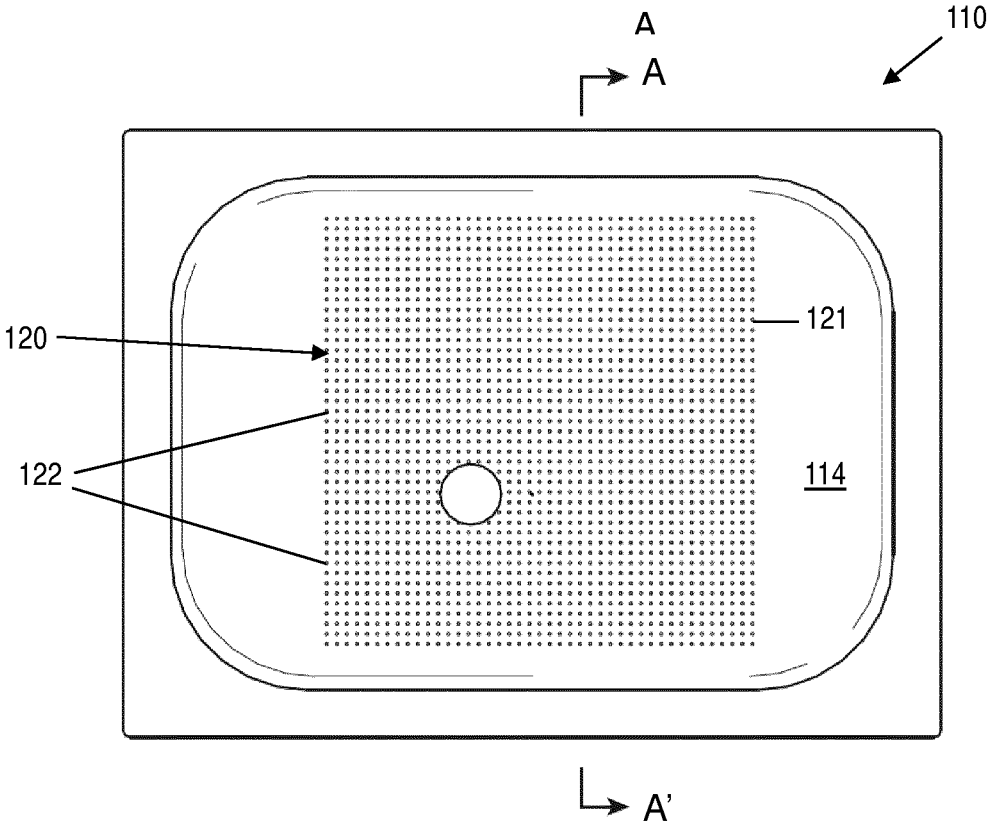
FIG. 7 is plan view of the shower tray of FIG. 6.
Figure 8:
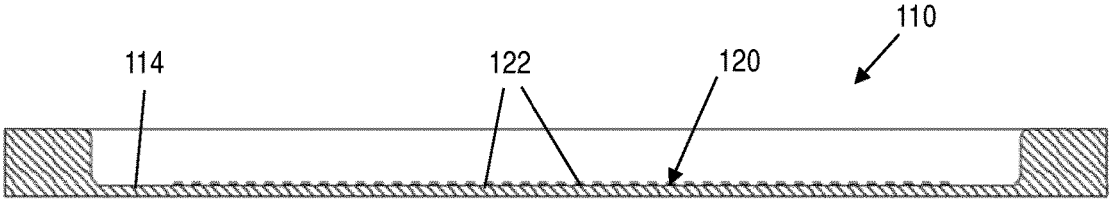
FIG. 8 is a sectional view of the shower tray of FIG. 6.
Figure 9:
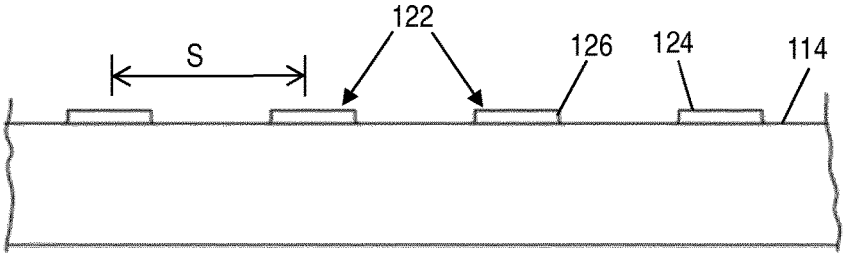
FIG. 9 is an enlarged side view of part of the anti-slip surface of the shower tray of FIG. 6.

Referring now in particular to FIGS. 4 and 5, the projections 22 are described in more detail. Each projection 22 has a top surface 24 that is preferably flat. It is preferred that the entire top surface 24 is flat although in alternative embodiments only part of the top surface 24 may be flat, in particular a peripheral part that runs around the edge of the top surface 24. In any event, the preferred projection 22 has an angular edge 26, i.e. an edge that is sharp or non-rounded, between the top surface 24 and the side 28 of the projection 22. In preferred embodiments, the edge 26 is right angled, i.e. provides a right-angled corner at the intersection of the top surface 24 and the side. The provision of the angular edge 26 is facilitated by the flatness of the top surface 24. Conveniently the top surface 24 is circular (i.e. when the projection 22 is viewed in plan as shown in FIG. 2). In alternative embodiments, the top surface 24 may take other regular or irregular shapes that may be rounded or angular, e.g. oval, elliptical, polygonal. In any case, the angular edge 26 is preferably annular, extending around the entire periphery of the projection 22. Similarly the side 28 is annular, extending around the projection. The shape of the side 28 (when viewed in plan) may vary depending on the shape of the top surface 24, for example the side 28 may be circular in plan view in embodiments where the top surface 24 is circular. Typically, the top surface 24, or at least its flat portion(s) as applicable, is disposed substantially parallel with the upper face 14 from which the projection 22 extends.

In preferred embodiments the diameter D of the top surface 24 is between 2 mm and 8 mm, preferably between 3 mm and 6 mm, and is most preferably 4.5 mm. More generally, these dimensions may be applied to the width of the top surface 24, when measured in at least one axial direction and preferably both perpendicular axial directions. In some cases where the width is not the same or constant in each axial direction, it is preferred that the respective widths remain within the ranges provided above. In preferred embodiments the diameter D' of the bottom 30 of the projection is between 4.5 mm and 10.5 mm, preferably between 5 mm and 7 mm, and is most preferably 6 mm. More generally, these dimensions may be applied to the width of the bottom 30, when measured in at least one axial direction and preferably both perpendicular axial directions. In some cases where the width is not the same or constant in each axial direction, it is preferred that the respective widths remain within the ranges provided above. Therefore the preferred area of the top surface 24 is between 3 $mm^2$ and 64 $mm^2$, more preferably between 9 $mm^2$ and 36 $mm^2$. In the particularly preferred embodiment where the top surface 24 is circular, the preferred area of the top surface 24 is between 3.14 $mm^2$ and 50.27 $mm^2$, more preferably between 7.07 $mm^2$ and 28.27 $mm^2$, the most preferred value being 15.90 $mm^2$. The preferred ranges provided above are inclusive and given to the nearest millimetre. The most preferred value is given to the nearest millimetre.

The height H of each projection 22 from the bottom 30 to the top 24 is preferably between 0.5 mm and 1.5 mm, more preferably between 0.6 mm and 0.9 mm, and is most preferably 0.75 mm. These range values are inclusive and given to the nearest tenth of a millimetre. The most preferred value is given to the nearest one hundredth of a millimetre.

The side 28 of the projection 22 extends between the bottom 30 and the top surface 24 and, together with the top surface 24, forms the edge 26. Advantageously, the side 28 is shaped such that it is substantially perpendicular to the top surface 24 at the edge 26. It is preferred that the edge 26 is right angled (making an angle of 90° between the top surface 24 and the side 28). However, in some embodiments, the angle of the edge 26 made between the top surface 24 and the side 28 may be greater than 90° by a small amount, e.g. up to 5° although preferably by no more than 2°.

Advantageously, the side 28 flares outwardly in a direction from the top surface 24 to the bottom 30. To this end the side 28, or at least part of it, is preferably curved in transverse cross-section (i.e. taken in a plane perpendicular to the face 14 as shown in FIG. 5), although the flared portion of the side 28 may alternatively have a straight cross-sectional profile extending obliquely to the face 14. In any event the flared portion of the side is located at the base of the projection 22 such that it meets the face 14.

In preferred embodiments, including the embodiment of FIGS. 1 to 5, the side 28 is curved from the edge 26 to the bottom 30. The transverse cross-sectional curvature of the side 28 is preferably such that the side 28 is tangential to the top surface 24 at the edge 26 in order to provide the desired right-angled edge 26. As can best be seen from FIG. 5, this is conveniently achieved by providing the side 28 with a cross-sectional curvature having a constant radius R. Preferably, the size of the constant radius R is the same as the height H of the projection 22. In preferred embodiments the radius R is between 0.5 mm and 1 mm, more preferably between 0.6 mm and 0.9 mm, and is most preferably 0.75 mm. These range values are inclusive and given to the nearest tenth of a millimetre. The most preferred value is given to the nearest one hundredth of a millimetre. In alternative embodiments (not illustrated), the side 28 may be provided with a cross-sectional curvature having more than one radius.

FIGS. 6 to 10 illustrate an alternative embodiment of an article 110, in particular a shower tray, having an anti-slip surface 120 in which like numerals are used to denote like parts an in respect of which the same or a similar description applies as made above in relation to the embodiment of FIGS. 1 to 5 unless otherwise indicated. The anti-slip surface 120 comprises an array 121 of projections 122 provided on the upper face 114 of the tray 110. The spacing, arrangement and height of the projections is preferably the same as described above for the array 21 of projections 22. The shape and size of the top surface 124 is preferably also the same as described for the projections 22.

The profile of the side 128 is similar to that of the side 28 in that it is shaped to be substantially perpendicular, preferably exactly perpendicular, to the top surface 124 at the edge 126, and in that it flares outwardly in a direction from the top surface 124 to the bottom 130, the flared portion being located at the base of the projection such that it meets with the face 114.

In this embodiment, the side 128 includes an upper portion 128A, which forms the edge 126 and extends from the edge 126 part way towards the bottom 130, that is substantially perpendicular, preferably perpendicular, to the top surface 124 (or at least to the flat portion of the top surface at the edge in cases where the top surface is not entirely flat). In preferred embodiments the upper portion 128A is also substantially perpendicular, preferably perpendicular, to the upper face 114.

The side 128 includes a lower portion 128B extending between the upper portion 128A and the bottom 130 that flares outwardly in a direction from the top surface 124 to the bottom 130. The lower portion 128B is preferably curved in transverse cross-section (i.e. taken in a plane perpendicular to the face 114 as shown in FIG. 10), but may alternatively be straight in transverse cross-section extending obliquely to the face 114.

The overall height H of each projection 122 from the bottom 130 to the top 124 is preferably between 0.5 mm and 1 mm, more preferably between 0.6 mm and 0.9 mm, and is most preferably 0.75 mm. The respective heights of the lower and upper portions 128A, 128B may vary from embodiment to embodiment. In preferred embodiments the height H' of the upper portion 128A is between 0.3 mm and 0.7 mm, preferably between 0.4 mm and 0.6 mm, the most preferred value being 0.5 mm. Preferably the height of the lower portion 128B (the difference between H and H' as shown in FIG. 10) is between 0.1 mm and 0.5 mm, more preferably between 0.15 mm and 0.35 mm, the most preferred value being 0.25 mm. These range values are inclusive and given to the nearest tenth or one hundredth of a millimetre as applicable. The most preferred value is given to the nearest one hundredth of a millimetre.

Figure 10:
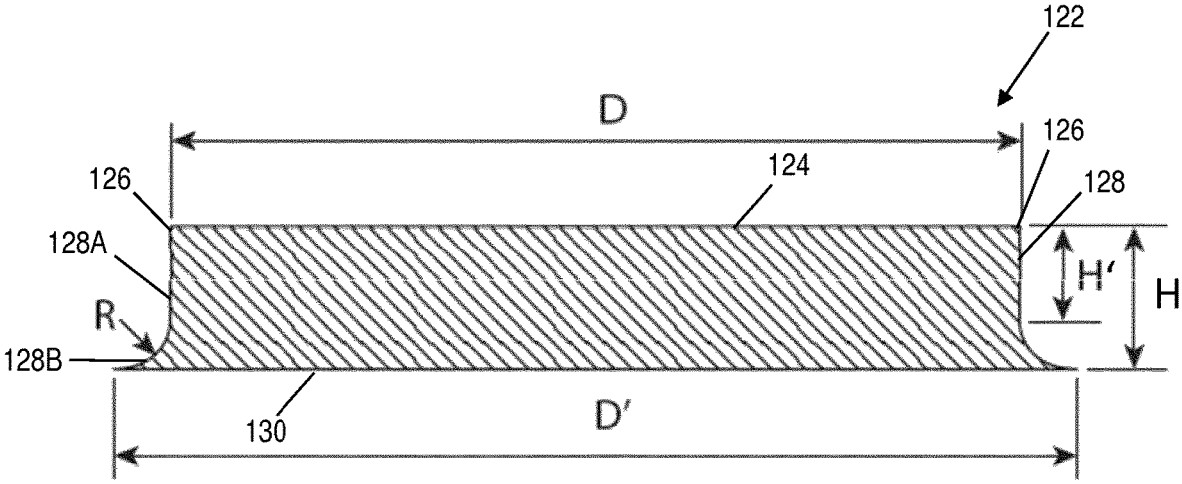
FIG. 10 is an enlarged side view of a projection that is part of the anti-slip surface of the shower tray of FIG. 6.

As can best be seen from FIG. 10, the curved lower portion 128B is conveniently created by providing the lower portion of side 128 with a cross-sectional curvature having a constant radius R. Preferably, the size of the constant radius R is the same as the height of the lower portion 128B. In preferred embodiments the radius R is between 0.15 mm and 0.35 mm, more preferably between 0.2 mm and 0.3 mm, and is most preferably 0.25 mm. These range values are inclusive and given to the nearest tenth or one hundredth of a millimetre as applicable. The most preferred value is given to the nearest one hundredth of a millimetre. In alternative embodiments (not illustrated), the lower portion 128B of side 128 may be provided with a cross-sectional curvature having more than one radius.

In preferred embodiments each projection 22, 122 is symmetrical about an axis (not shown) running perpendicular to the face 14, 114 in which case its transverse cross-sectional profile (such as shown in FIGS. 5 and 10) is the same around the projection 22, 122. In alternative embodiments, the projections 22, 122 may not be axially symmetrical, although they may at least be symmetrical about one or more planes that are perpendicular to the face 14, in which case the cross-sectional profile may not be constant around the whole of the projection.

In preferred embodiments, all of the projections 22, 122 in the array 21, 121 have the same shape and dimensions. More generally it is preferred that all of the projections 22, 122 in the array 21, 121 are substantially uniform in shape and dimensions. Alternatively however the shape and/or dimension(s) of the projections 22, 122 in the array 21, 121 may differ from each other (although preferably still falling within the respective ranges provided above). It is preferred that at least the overall height H of the projections 22, 122 in the array 21, 121 are the same.

In preferred embodiments, the projections 22, 122 are rigid, or non-deformable (at least in the context of the intended use of the article 10, 110, e.g. in response to application of the weight of a user). The projections 22, 122 may be formed from any suitable material, typically from the same material that the article 10, 110 is formed from, e.g. a plastics, metallic, composite, rubber or stone based material including but not limited to acrylic, stone, resin stone, steel, ceramic, glass reinforced plastics (GRP). It is particularly preferred that the projections 22, 122 are integrally formed with the face 14, 114 of the article 10, 110, preferably by any suitable conventional moulding manufacturing process. It will be apparent that depending on what the article 10, 110 is (e.g. in the case of tray, tile or mat), the projections 22, 122 may be co-formed with the article 10, 110 as a whole when the article is being manufactured. The projections 22, 122 are particularly suited for manufacture by moulding in order to obtain the desired shape and dimensions, and advantageously also the desired rigidity. In alternative embodiments, the array 21, 121 of projections 22, 122 may be formed on or in an article (such as a sheet, mat, plate or other substrate) that can be fixed to the upper surface of another article (such as a shower tray) to provide the anti-slip surface.

The anti-slip surface may be provided on any relevant surface(s) of an article typically an upper surface on which a user may stand, walk or run, of any other suitable article, for example a tile, mat or other flooring article, or a bath, wet room tray or other sanitary ware article, usually on the in-use upper surface. More generally the invention is particularly suited for use with articles that tend to become wet during use, e.g. sanitary ware or flooring for use in or around pools, baths showers or the like.

It is found that anti-slip surfaces 20, 120 made in accordance with the invention exhibit high anti-slip properties and more particularly allow anti-slip standards such as British Standard BS 7976 to be met without causing discomfort to the user. In particular, preferred embodiments meet British Standard BS 7976: Parts 1-3, 2002 and A1, 2003. Advantageously, the provision of the flared portion at the bottom of the projections 22, 122 facilitates cleaning of the surface 20, 120.

The invention is not limited to the embodiment(s) described herein but can be amended or modified without departing from the scope of the present invention.

The invention claimed is:

1. A surface on which a user may stand comprising at least one face having an anti-slip surface, the anti-slip surface comprising:

a plurality of spaced apart projections raised with respect to the respective face, said projections having a top surface and a side extending between said top surface and said respective face, wherein each projection:

has a height of 0.5 mm to 1.5 mm, a top surface with an area of 3 $mm^2$ to 64 $mm^2$, and is shaped to have an angular edge between said top surface and said side, wherein adjacent projections are spaced apart by 10 mm to 16 mm such that a gap is formed between the sides of each projection, and a size of the gap is 2 mm to 14 mm.

2. The surface of claim 1, wherein said angular edge is right angled.

3. The surface of claim 1, wherein said angular edge is annular, extending around the periphery of said top surface.

4. The surface of claim 1, wherein at least one of a peripheral portion of said top surface is flat, or the whole of said top surface is flat.

5. The surface of claim 1, wherein the side is shaped such that it is substantially perpendicular to the top surface at said edge.

6. The surface of claim 1, wherein said top surface is circular and the top surface area is 3.14 $mm^2$ to 50.27 $mm^2$.

7. The surface of claim 1, wherein the side is curved in transverse cross-section and shaped to flare outwardly at a base of the projection, wherein, the side is curved from:

the edge to the respective face, or from a position on the side located between the edge and the respective face to the respective face.

8. The surface of claim 7, wherein a transverse cross-sectional curvature of the side is such that the side is tangential to the top surface at the edge.

9. The surface of claim 7, wherein a transverse cross-sectional curvature of the side comprises a constant radius the same as the height of the projection, and said radius is 0.5 mm to 1 mm.

10. The surface of claim 9, wherein said radius is 0.75 mm and said height is 0.75 mm.

11. The surface of claim 7, wherein said side comprises an upper portion and a lower portion, wherein, said upper portion in part forms the edge, and said upper portion extends from the edge part way to a top of the lower portion, and said lower portion extends from a bottom of said upper portion to said respective face, wherein said upper portion is substantially perpendicular with said top surface, and said lower portion is curved in transverse cross-section and shaped to flare outwardly at the base, wherein a transverse cross-sectional curvature of the lower portion of the side comprises a constant radius the same as a height of the lower portion, and a height of the upper portion is between 0.3 mm and 0.7 mm and a height of the lower portion is between 0.1 mm and 0.5 mm.

12. The surface of claim 1 wherein the overall height of each projection is between 0.6 mm and 0.9 mm.

13. The surface of claim 11, wherein the height of the lower portion is 0.15 mm to 0.35 mm.

14. The surface of claim 11, wherein the height of the upper portion is 0.5 mm and the height of the lower portion is 0.25 mm.

15. The surface of claim 1, wherein the area of the top surface is between 9 $mm^2$ and 36 $mm^2$.

16. The surface of claim 6, wherein said top surface area is 7.07 $mm^2$ to 28.27 $mm^2$.

17. The surface of claim 1, wherein the projections are arranged in an array comprising rows and columns of said projections, wherein said array is a regular array, and the spacing between adjacent projections in any row or column is 10 mm to 16 mm.

18. The surface of claim 17 wherein all of the projections in the array are of substantially uniform in at least one of shape, height, or size.

19. The surface of claim 1, wherein said projections are non-deformable.

20. The surface of claim 1 wherein said article is a moulded article, and said projections are integrally formed with said respective face.

21. The surface of claim 1, wherein said article is a tray for a shower or wet room.

22. A tray for a shower or wet room, said tray comprising at least one face having an anti-slip surface, the anti-slip surface comprising a plurality of spaced apart projections raised with respect to the respective face, said projections having a top surface and a side extending between said top surface and said respective face, wherein each projection:

has a height of 0.5 mm to 1.5 mm, a top surface with an area of 3 $mm^2$ to 64 $mm^2$, and is shaped to have an angular edge between said top surface and said side, wherein adjacent projections are spaced apart by 10 mm to 16 mm such that a gap is formed between the sides of each projection, and a size of the gap is 2 mm to 14 mm.

23. The surface of claim 1, wherein:

the area of the top surface is 20.25 $mm^2$, the height of each projection is 0.75 mm, the projections are arranged in an array comprising rows and columns, and the spacing between adjacent projections in any row or column is 12 mm.

24. The surface of claim 6, wherein:

the top surface area is 15.90 $mm^2$, the height of each projection is 0.75 mm, the projections are arranged in an array comprising rows and columns, the spacing between adjacent projections in any row or column is 12 mm, and the size of the gap is 6 mm to 7.5 mm.

* * * * *